United States Patent [19]

Okada

[11] 4,411,598

[45] Oct. 25, 1983

[54] FLUID PROPELLER FAN

[75] Inventor: Makoto Okada, Tokyo, Japan

[73] Assignee: Nissan Motor Company, Limited, Kanagawa, Japan

[21] Appl. No.: 212,430

[22] Filed: Dec. 3, 1980

[30] Foreign Application Priority Data

Dec. 12, 1979 [JP] Japan ..... 54-171946[U]

[51] Int. Cl.[3] ..... F04D 29/38

[52] U.S. Cl. ..... 416/223 R; 416/245 R; 416/DIG. 2

[58] Field of Search ..... 416/242, DIG. 2, 223 R, 416/188, 245 B, 245 R

[56] References Cited

U.S. PATENT DOCUMENTS 1,825,184 9/1931 Glanschnig ..... 416/223

2,116,055 5/1938 Weichwald ..... 416/223

*Primary Examiner*—Harvey C. Hornsby

*Assistant Examiner*—Christine A. Peterson

[57] ABSTRACT

A fluid propeller fan useful as but not limited to an air-circulating cooling fan for an automotive engine, wherein each of the vanes of the fan has a pitch angle which is gradually reduced from the tip or an intermediate portion toward the radially innermost end of the vane so as to provide an increased draught volume and improved draught flow characteristics.

1 Claim, 13 Drawing Figures

FLUID PROPELLER FAN

FIELD OF THE INVENTION

The present invention relates in general to fluid propeller fans and, particularly, to the vane structure of the fan wheel rotor of a fluid propeller fan. While the vane structure of a fluid propeller fan proposed by the present invention will find a wide variety of practical applications for industrial purposes and in household appliances, such a structure will prove advantageous especially when used as part of a powerdriven air-circulating cooling fan for an internal combustion engine installed in an automotive vehicle.

BACKGROUND OF THE INVENTION

An air-circulating cooling fan for an automotive engine of, for example, the water-cooled type is driven by the crankshaft of the engine through suitable power transmission means such as a fluid coupling or by a vehicle-mounted motor. The major intents of such a fan include positively promoting passage of air through the water-cooling radiator of a vehicle and circulating air around the engine body positioned on the leeward side of the fan. Promoted passage of air through the radiator enhances the heat exchange performance of the radiator through which cooling water for the engine is to be circulated to reject heat to the atmosphere. The air forced to flow around the engine cools the engine body and other associated members subjected to the attack of the heat generated by the engine during operation of the automotive vehicle.

The vane structure of a known air-circulating cooling fan used for such a purpose is designed so that the fan functions as a compromise between a centrifugal fan and an axial-flow fan so as to be capable of delivering large draught volumes or high rates of volumetric flow with high pressures for given duties.

One of the prominent problems encountered in a priorart fluid propeller fan of this nature is that suction tends to be developed around and in the neighbourhood of the axis of rotation of the wheel rotor of the fan. The suction thus built up around the vane-carrying hub of the fan wheel rotor draws air toward the hub from the leeward side of the fan and, as a consequence, causes reduction in the volume of the draught to be ultimately delivered from the fan. The reduction in the amount of draught available of an air-circulating propeller fan for a given duty gives rise to a decrease in the performance efficiencies of the fan and further to deterioration in the quiet-operating characteristics of the fan for increased duties when the fan is used, particularly, as a cooling fan for an automotive internal combustion engine.

The present invention contemplates elimination of these drawbacks inherent in a conventional fluid propeller fan of the type designed as a compromise between a centrifugal fan and an axial-flow fan.

It is, accordingly, an object of the present invention to provide an improved fluid propeller fan capable of delivering increased draught volumes or rates of volumetric flow for any given duties.

It is another object of the present invention to provide an improved fluid propeller fan which features an increased performance efficiencies and excellent quiet-operating characteristics.

It is still another object of the present invention to provide an improved fluid propeller fan providing advantages of both of a centrifugal fan and an axial-flow fan and nevertheless free from development of suction around and in the neighbourhood of the axis of rotation of the fan wheel rotor thereof.

SUMMARY OF THE INVENTION

In accordance with the present invention, these objects are accomplished basically in a fluid propeller fan including a fan wheel rotor assembly which comprises a wheel hub having an axis therethrough and rotatable about the axis, and a plurality of vanes extending radially from the wheel hub and angularly spaced apart from each other about the axis of rotation of the wheel hub, wherein each of the vanes has a pitch angle which gradually decreases toward the wheel hub. In this instance, each of the vanes may be shaped in such a manner as to have a radially outer longitudinal portion having a pitch angle substantially constant throughout the length of the particular portion and a radially inner longitudinal portion having a pitch angle which decreases gradually toward the wheel hub of the fan wheel rotor assembly away from the radially outer longitudinal portion of each vane. As an alternative, each of the vanes forming part of the fan wheel rotor assembly of the fluid propeller fan according to the present invention may be shaped so that the pitch angle thereof decreases gradually from the radially outermost end of each vane to the wheel hub of the rotor assembly.

BRIEF DESCRIPTION OF THE DRAWINGS

The drawbacks of prior-art air-circulating cooling fans of the type described and the features and advantages of a fluid propeller fan proposed by the present invention to overcome such drawbacks of the known air-circulating cooling fans will be more clearly understood from the following description taken in conjunction with the accompanying drawings, in which.

Throughout the figures presented in the accompanying drawings, like reference numerals and characters designate similar or corresponding units, members and elements although some of such units, members and elements may appear somewhat different in shape and construction from one another.

DETAILED DESCRIPTION OF THE PRIOR ART

Figure 1A:
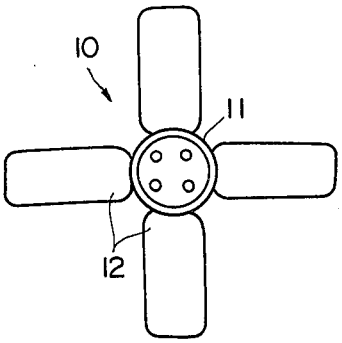
FIG. 1A PRIOR ART
FIG. 1A is a plan view showing an example of the fan wheel rotor assembly of a prior-art air-circulating propeller fan of the described type.
Figure 1B:
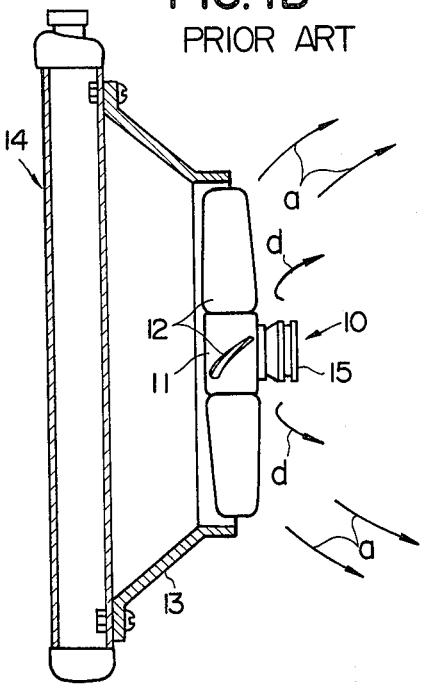
FIG. 1B PRIOR ART
FIG. 1B is a side elevation view showing, partly in vertical section, the arrangement in which an air-circulating propeller fan using the fan wheel rotor assembly illustrated in FIG. 1A is installed, as an engine cooling fan, in association with the radiator grille structure of an automotive vehicle.

Referring to FIG. 1A of the drawings, a prior-art fluid propeller fan has a fan wheel rotor assembly 10 which is shown comprising a generally cylindrical center hub 11 and a plurality of fan vanes 12 extending radially from the center hub 11 and equiangularly spaced apart from each other about the center axis of the hub 11. In FIG. 1B, the fan wheel rotor assembly 10 is shown positioned in part within a fluid outlet end portion of a frusto-conical shroud 13 secured by bolts and nuts to a radiator grille structure 14.

The radiator grille structure 14 is herein assumed as forming part of a cooling system for a water-cooled internal combustion engine (not shown) of an automotive vehicle. The fan wheel rotor assembly 10 of the propeller fan thus serving as an air-circulating engine-cooling fan is driven for rotation about the center axis of the hub 11 by the crankshaft of the engine through, for example, a fluid coupling (not shown) or directly by an electric motor (not shown). The rotation of the fan wheel rotor 10 causes the individual vanes 12 to propel air rearwardly from the rotor assembly 10 and induces suction between the rotor assembly 10 and the radiator grille structure 14. The atmospheric air in front of the radiator grille structure 14 is therefore drawn through the grill structure 14 to the fan wheel rotor assembly 10 and is discharged rearwardly from the rotor assembly 10, as is well known in the art. Designated by reference numeral 15 is a coupling member for providing connection between the center hub 11 of the fan wheel rotor assembly 10 and a drive shaft (not shown) to be driven by the engine or the electric motor as above discussed.

With a view to achieving a large draught volume by the propeller fan thus used as the air-circulating cooling fan for an automotive engine, the vane structure of the wheel rotor assembly 10 of the fan is designed so that each of the fan vanes 12 has a relatively large pitch angle $\theta$ which usually ranges from about 50 degrees to about 60 degrees as will be seen from the illustration of FIG. 1B. As will also be seen from FIG. 1B, each of the fan vanes 12 is slightly twisted toward its tip and has a radially outer end portion having a pitch angle reduced as compared with the pitch angle of its base portion.

Figure 2A:
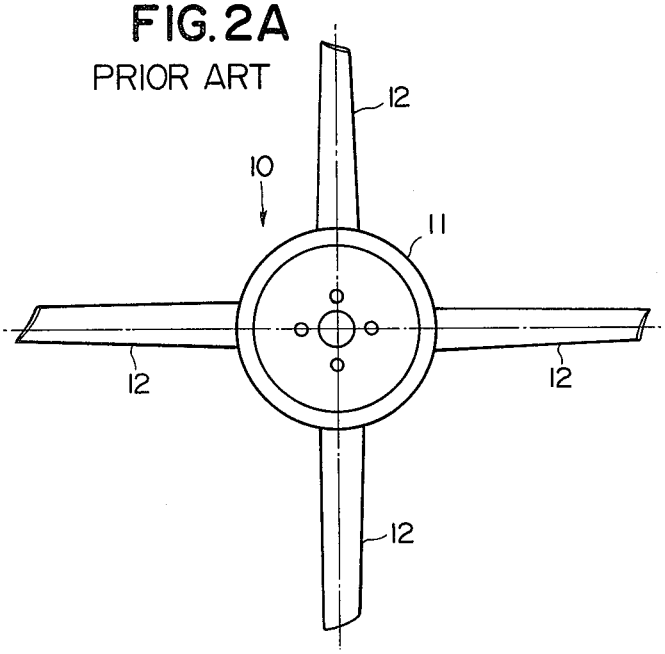
FIG. 2A PRIOR ART
FIG. 2A is a view similr to FIG. 1A but shows another example of the fan wheel rotor assembly of a prior-art air-circulating propeller fan of the described type.
Figure 2B:
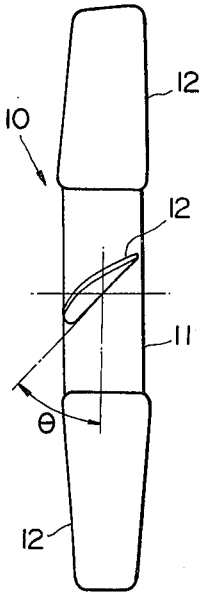
FIG. 2B PRIOR ART
FIG. 2B is a side elevation view of the fan wheel rotor assembly illustrated in FIG. 2A.

In FIGS. 2A and 2B of the drawings is shown another type of prior-art fan wheel rotor assembly 10 having fan vanes 12 which are designed similarly to those of the fan wheel rotor assembly 10 above described with reference to FIGS. 1A and 1B.

Figure 3:
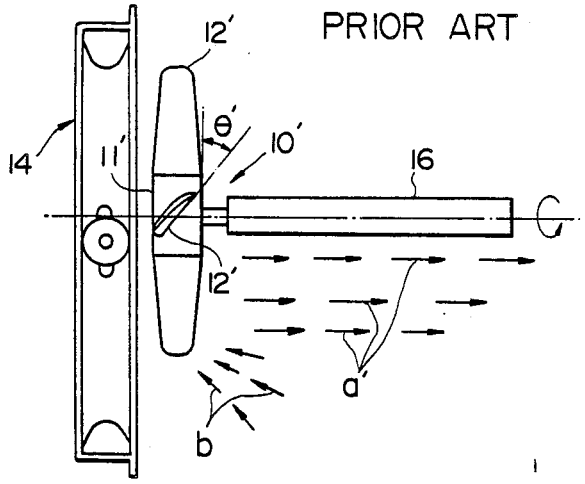
FIG. 3 PRIOR ART
FIG. 3 is a plan view showing the arrangement in which an air-circulating propeller fan having an ordinary vane design is used as a cooling fan for an automotive internal combustion engine and installed in association with the radiator grille structure of an automotive vehicle.

By reason of such designs of the vanes 12, the propeller fan using the fan wheel rotor assembly 10 of the type illustrated in FIGS. 1A and 1B or FIGS. 2A and 2B has not only the intrinsic functions of an axial-flow fan but functions which are partially tantamount to those of a centrifugal fan. It therefore follows that the draught of air delivered from the fan assumes a generally conical form having its imaginary voltex located in front of or on the windward side of the fan wheel rotor assembly 10 as will be seen from the directions of the flows of air indicated by arrows a in FIG. 1B. Such a draught flow characteristic of the fan wheel rotor assembly 10 will be clearly understood when considered in comparison with the draught flow characterisic of an ordinary fan wheel rotor assembly 10' of an axial-flow propeller fan as illustrated in FIG. 3. The fan wheel rotor assembly 10' of the axial-flow propeller fan shown in FIG. 3 has fan vanes 12' each having a pitch angle $\theta'$ which is smaller than a stalling angle so that the vanes 12' are capable of propelling air mostly in directions parallel with the aixs of rotation of the fan wheel rotor assembly 10', as indicated by arrows a'. In FIG. 3, the fan wheel rotor assembly 10' is also assumed to be part of an air-circulating engine-cooling fan and is therefore provided in association with a radiator grille structure 14 of an automotive vehicle. Designated by reference numeral 16 is a drive shaft which is connected at one end to the center hub 11' of the fan wheel rotor assembly 10' for connection at the other end thereof to the output shaft of an electric motor or the crankshaft of an engine through, for example, a fluid coupling.

One of the drawbacks of an axial-flow fan using the fan wheel rotor assembly 10' shown in FIG. 3 is that the volume of the draught which can be delivered from the fan is limited since the flows of air discharged from the fan wheel rotor assembly 10' have practically no velocity components in radial directions of the rotor assembly 10'. Another drawback is that eddy currents tend to be induced on the leeward side of the circular path of tip portions of the fan vanes 12' as indicated by arrows b in FIG. 3 and deteriorate the performance efficiency of the fan during operation of the fan wheel rotory assembly 10'.

Figure 4:
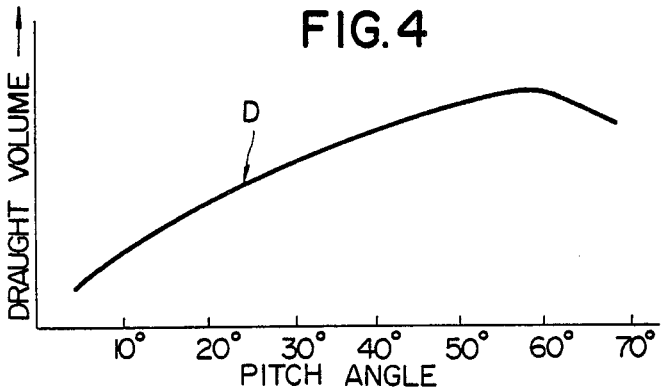
FIG. 4 is a chart showing an example of the relationship between the pitch angle of each of the vanes of an air-circulating propeller fan and the draught volume achievable by the fan.

As the pitch angles of the vanes of a propeller fan are increased progressively without changing the speed of rotation of the wheel rotor assembly of the fan, the flows of air discharged from the fan wheel rotor assembly diverge away from the fan wheel rotor assembly in generally bell-mouthed form about a rearward extension of the axis of rotation of the rotor assembly and, in addition, the eddy currents induced in the vicinity of the circular path of the tip portions of the vanes are reduced. For these reasons, the draught volumes of propeller fans at given speeds of rotation of the fan rotors increase as the pitch angles of the vanes of the fans increase, as will be seen from curve D shown in the chart of FIG. 4 wherein the draught volume is seen to peak up in the vicinity of 60 degrees of pitch angle.

Because of such large draught volumes achievable, propeller fans using large-pitch angle vanes as in the case of the fan using the fan wheel rotor assembly 10 shown in FIGS. 1A and 1B or FIGS. 2A and 2B are useful especially as air-circulating engine-cooling fans which are required to not only cool the radiator of a vehicle but blow air around the engine body positioned on the leeward side of the fan.

Figure 5:
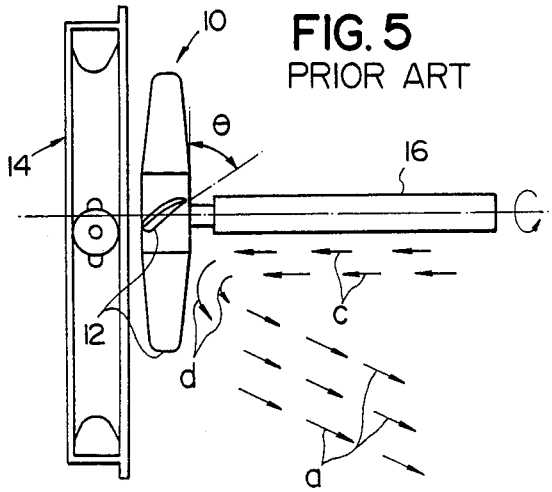
FIG. 5 PRIOR ART
FIG. 5 is a view similar to FIG. 3 but shows the arrangement in which the air-circulating propeller fan illustrated in FIG. 3 is designed to have vanes shaped similarly to those of the prior-art fan wheel rotor assembly shown in FIGS. 1A and 1B or in FIGS. 2A and 2B.

Such an advantage of a propeller fan using steep-pitch angle vanes is, however, more or less offset by a problem that suction tends to be built up on the leeward side of the path of the base portions of the vanes spinning about the axis of rotation of the fan wheel rotor assembly. The suction induces axial flows of air on the leeward side of the rotor assembly 10 in forward directions toward a center portion of the fan wheel rotor assembly 10 as indicated by arrows c in FIG. 5. These axial flows not only in themselves cause reduction in the draught volume but give rise to induction of turned-back flows at the rear of the fan wheel rotor assembly 10 as indicated by arrows d in FIGS. 1B and 5. The turned-back flows of air take up portions of the normal, frusto-conically advancing flows of air (the arrows a) and thereby cause further reduction in the draught volume which can be achieved by the fan. This results in deterioration in the heat exchange efficiency of the radiator and the efficiency at which the engine body is to be cooled by the air delivered from the fan.

The present invention aims at elimination of these draw-backs of a fluid propeller fan of the design which has conventionally been put to use for providing a compromise between an axial-flow fan and a centrifugal fan.

DESCRIPTION OF THE EMBODIMENTS

Figure 6A:
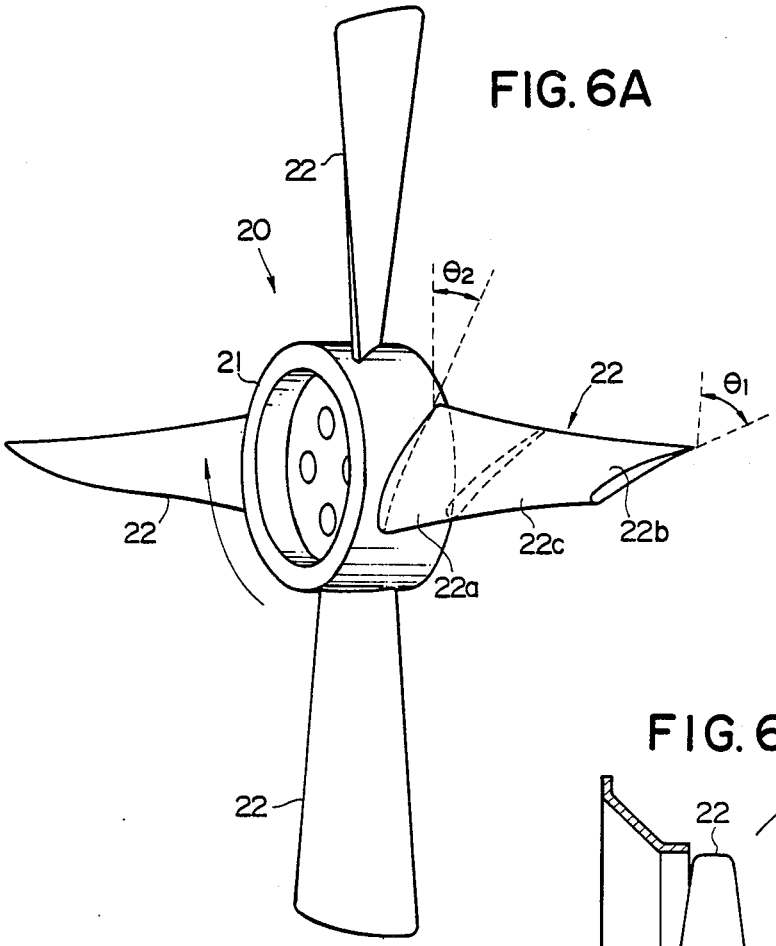
FIG. 6A is a perspective view showing, to an enlarged scale, a fan wheel rotor assembly forming part of a fluid propeller fan embodying the present invention.
Figure 6B:
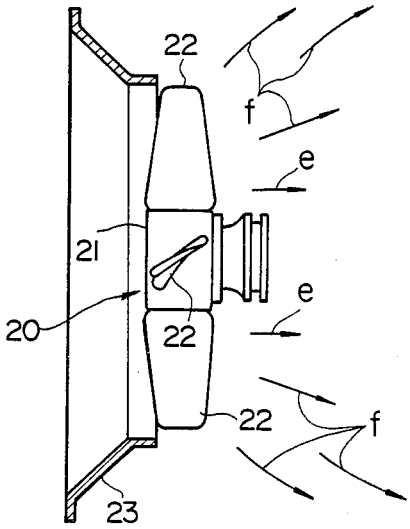
FIG. 6B is a plan view showing the entire construction of the fluid propeller fan including the fan wheel rotor assembly depicted in FIG. 6A.
Figure 6C:
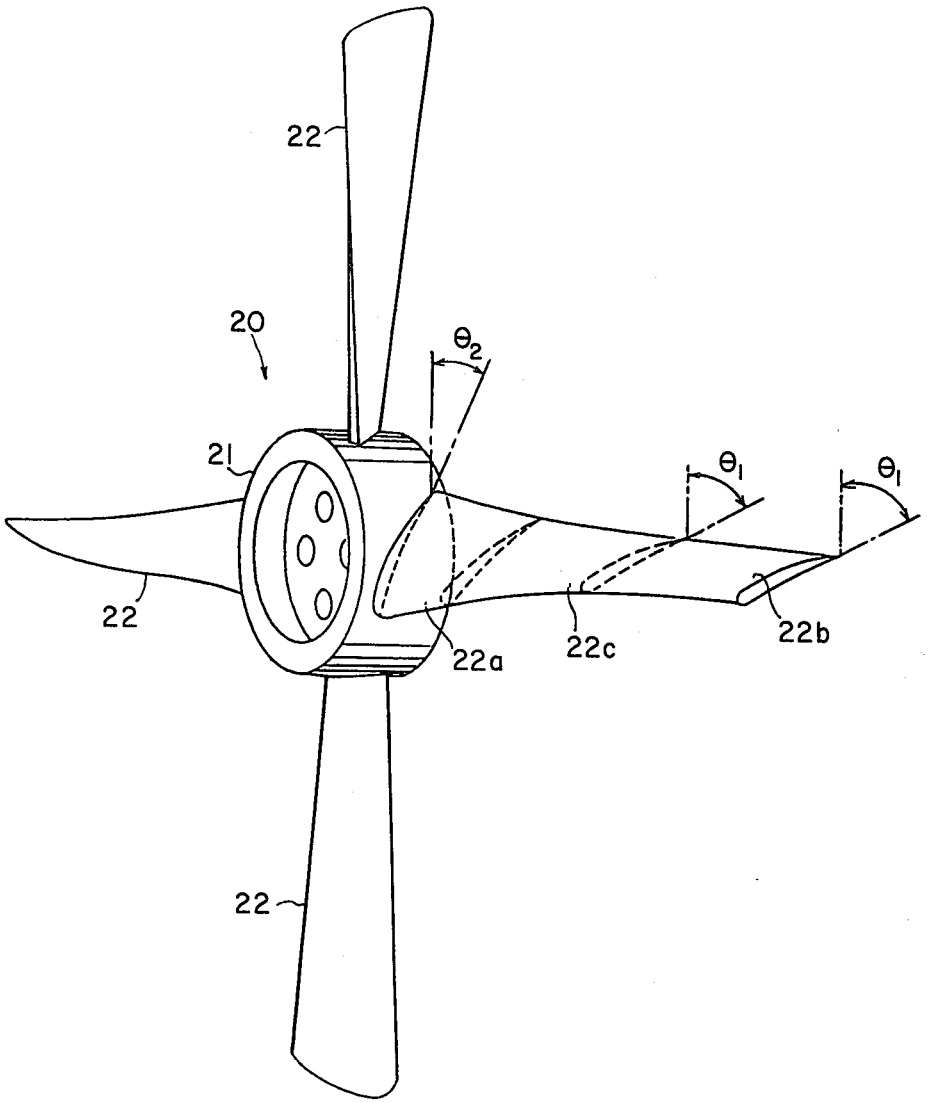
FIG. 6*c* is a perspective view similar to FIG. 6*a* but showing a modification of the fan wheel rotor assembly forming part of a fluid propeller fan embodying the present invention.

FIGS. 6A and 6B show a first preferred embodiment of the fluid propeller fan to achieve such an end of the present invention.

Referring to FIGS. 6A and 6B of the drawings, the embodiment of the present invention is shown including a fan wheel rotor assembly 20 which comprises a generally cylindrical wheel hub 21 having a center axis therethrough and rotatable about the axis and a plurality of fan vanes 22 extending radially outwardly from the wheel hub 21 and angularly spaced apart from each other about the axis of rotation of the hub 21. In FIG. 6B, the fan wheel rotor assembly 20 is further shown as being in part positioned within a fluid outlet end portion of a generally frustoconical shroud 23 and being provided with a coupling 24 for connection to a drive shaft (not shown).

Each of the vanes 22 of the fan wheel rotor assembly 20 has, with respect to a plane perpendicular to the axis of rotation of the rotor assembly 20, a pitch angle which gradually decreses toward the wheel hub 21. If, thus, each of the fan vanes 22 has a pitch angle which is $\theta_1$ degrees at its tip and $\theta_2$ degrees at its radially innermost end adjacent to the outer peripheral surface of the wheel hub 21 as indicated in FIG. 6A, the angle of $\theta_2$ degrees is smaller than the angle of $\theta_1$ degrees so that the pitch angle of each vane 22 decreases from $\theta_1$ at the radially outermost end of the vane to $\theta_2$ at the radially innermost end of the vane.

The pitch angles $\theta_1$ and $\theta_2$ of each of the vanes 22 are selected so that radially inner portions of the individual vanes 22 are capable of providing draught flow characteristics of axial-flow fans while radially outer portions of the vanes 22 are capable of providing draught flow characteristics of centrifugal fans, respectively. The angles $\theta_1$ and $\theta_2$ to provide such dual draught flow characteristics range, by way of example, from about 40 to 60 degrees for the angle $\theta_1$ and from about 10 to 20 degrees for the angle $\theta_2$.

The vane structure of the fan wheel rotor assembly 20 of the embodiment illustrated in FIGS. 6A and 6B is assumed, also by way of example, to be such that the pitch angle of each of the vanes 22 of the rotor assembly 20 decreases gradually from the radially outer end of the vane to the wheel hub 21, viz., throughout the radial length of the vane. If desired, however, each of the vanes 22 may be shaped in such a manner as to have a radially outer longitudinal portion having a substantially constant pitch angle (of $\theta_1$ degrees) throughout the particular portion of the vane and a radially inner longitudinal portion having a pitch angle which decreases gradually toward the wheel hub 21 from the radially outer longitudinal portion of the vane.

In operation of the fluid propeller fan having the vanes 22 thus configured, the streams of air which impinge upon respective base portions **22*a* of the individual vanes 22 from the windward side of the fan wheel rotor assembly 20 being driven for rotation are forced to advance in axial directions on the leeward side of the rotor assembly 20 as indicated by arrows e in FIG. 6B. On the other hand, the streams of air impinging upon respective tip portions 22*b* and intermediate portions 22*c* of the vanes 22 from the windward side of the fan wheel rotor assembly 20 are given velocity components in radial directions of the rotor assembly 20 and are thereby forced to diverge in generally bell-mouthed form about a rearward extension of the axis of rotation of the rotor assembly 20, as indicated by arrows f in FIG. 6B**.

In the fluid propeller fan illustrated in FIGS. 6A and 6B, the respective base portions **22*a* of the vanes 22 play the role of the vanes of an axial-flow fan and the respective tip and intermediate portions 22*b* and 22*c* of the vanes 22 play the role of the vanes of a centrifugal fan. The axial flows of air induced by the base portions 22*a* of the vanes 22 preclude formation of the previously mentioned turnedback flows (indicated by the arrows d in FIGS. 1B and 5) at the rear of the fan wheel rotor assembly 20 and contribute to augmentation of the total draught volume. The diverging flows of air induced by the tip and intermediate portions 22*b* and 22*c* of the vanes 22 lend themselves to elimination of the eddy currents (indicated by the arrows b in FIG. 3) that would otherwise be produced along the paths of these portions of the vanes 22**.

The fan wheel rotor assembly 10 in the embodiment of the fluid propeller fan hereinbefore described with reference to FIGS. 6A and 6B is shown as having four fan vanes 22, but it will be apparent that the inventive gist of the embodiment therein shown can be realized in a fluid propeller fan using a smaller or larger number of vanes as part of its fan wheel rotor assembly.

Figure 7A:
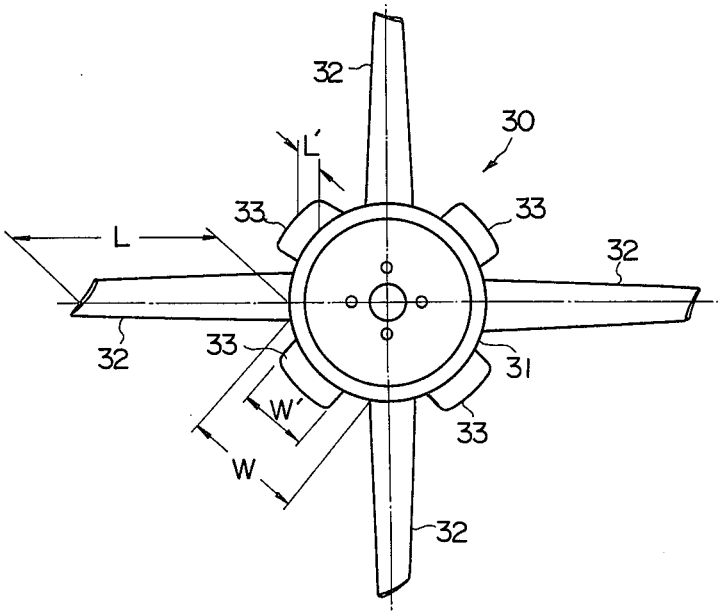
FIG. 7A is a plan view of a fan wheel rotor assembly forming part of another embodiment of the fluid propeller fan according to the present invention.
Figure 7B:
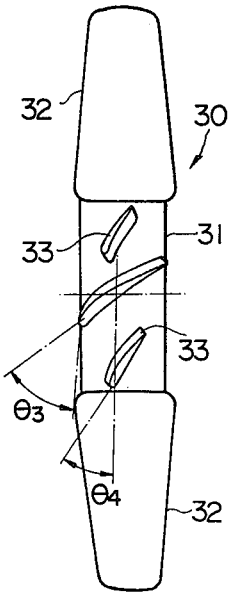
FIG. 7B is a side elevation view of the fan wheel rotor assembly illustrated in FIG. 7A.

Turning to FIGS. 7A and 7B of the drawings, there is shown the fan wheel rotor assembly of a second preferred embodiment of the fluid propeller fan according to the present invention. The fan wheel rotor assembly, now designated in its entirety by reference numeral 30, comprises a generally cylindrical wheel hub 31 having a center axis therethrough and rotatable about the axis, and two sets of, main and auxiliary fan vanes 32 and 33 extending radially outwardly from the wheel hub 31. The main fan vanes 32, which are shown provided as four in number by way of example, are angularly spaced apart from each other about the center axis of the wheel hub 31. On the other hand, the auxiliary fan vanes 33 are positioned respectively intermediate of the main fan vanes 32 so that the main and auxiliary vanes 32 and 33 are arranged alternately to one another about the center axis of the wheel hub 31.

With respect to the axis of rotation of the fan wheel rotor assembly 30, each of the main fan vanes 32 has a relatively large pitch angle $\theta_3$ substantially throughout the radial length thereof and each of the auxiliary fan vanes 33 has; substantially throughout the radial length thereof, a pitch angle $\theta_4$ which is smaller than the pitch angle $\theta_3$ of each main fan vane 32, as indicated in FIG. 7B. The pitch angle $\theta_3$ of each of the main fan vanes 32 is preferably within the range of from about 50 degrees to about 60 degrees, while the pitch angle $\theta_4$ of each of the auxiliary fan vanes 33 is preferably within the range of from about 20 degrees to about 35 degrees. Thus, the main fan vanes 32 of the fan wheel rotor assembly 30 play the role of the vanes of a centrifugal fan and the auxiliary fan vanes 33 of the rotor assembly 30 play the role of the vanes of an axial-flow fan, as will be readily understood.

When four vanes are used as the main vanes of the fan wheel rotor assembly 30 having the main and auxiliary vanes 32 and 33 thus configured individually and if, in this instance, the main vanes 32 are arranged equiangularly about the center axis of the wheel hub 31 with each of the auxiliary vanes 33 equiangularly spaced apart from every adjacent two of the main vanes 32, it is preferable that the radial length L' of each of the auxiliary vanes 33 be approximately equal to one sixth (1/6) to one third ($\frac{1}{3}$) of the radial length L of each of the main vanes 32, as will be seen from FIG. 7A. In this instance, it will be further preferable that the chordal width W' of each of the auxiliary vanes 33 be approximately equal to three fourths ($\frac{3}{4}$) to one half ($\frac{1}{2}$) of the chordal width W of each of the main vanes 32.

Figure 7C:
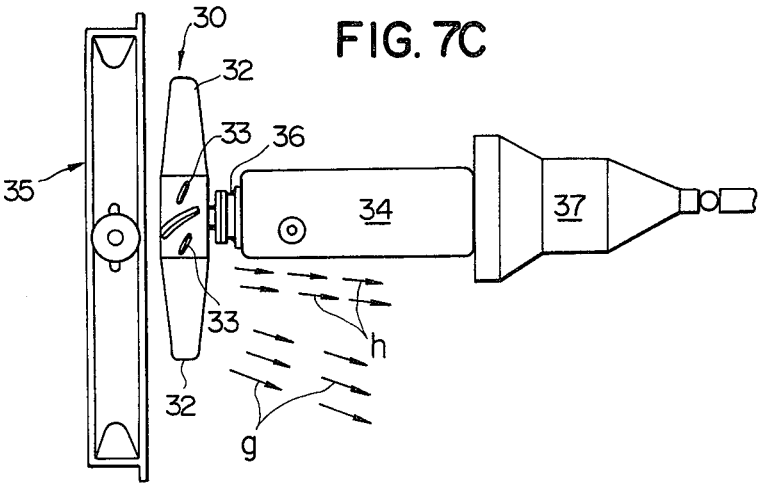
FIG. 7C is a plan view showing the arrangement in which the fluid propeller fan including the fan wheel rotor assembly illustrated in FIGS. 7A and 7B is installed, as an engine cooling fan, in association with the internal combustion engine, power transmission and radiator grille structure of an automotive vehicle.

FIG. 7C shows the arrangement in which the fluid propeller fan having the fan wheel rotor assembly 30 thus constructed is used as an air-circulating cooling fan for an internal combustion engine 34 installed in an automotive vehicle and is thus positioned on the leeward side of a radiator grille structure 35 forming part of the cooling system for the engine 34. The wheel hub 31 of the fan wheel rotor assembly 30 is thus shown connected to the crankshaft (not shown) of the engine 34 by means of a suitable coupling 36 such as a fluid coupling. The crankshaft of the engine 34 is further connected to an input shaft (not shown) of a power transmission 37.

When, now, the internal combustion engine 34 is in operation and drives the fan wheel rotor assembly 30 of the air-circulating engine cooling fan for rotation about the center axis of the wheel hub 31, the streams of air propelled by the main vanes 32 of the rotor assembly 30 are directed in generally bell-mouthed form about a rearward extension of the axis of rotation of the rotor assembly 30 and blow around the body structure of the engine 34 as indicated by arrows g in FIG. 7C. On the other hand, the streams of air propelled backwardly by the auxiliary vanes 33 are forced to advance in directions approximately parallel with the rearward extension of the axis of rotation of the fan wheel rotor assembly 30 as indicated by arrows h in FIG. 7C. The auxiliary vanes 33 playing the role of the vanes of an axial-flow fan are thus operative to preclude induction of forward axial flows (indicated by the arrows c in FIG. 5) toward the fan wheel rotor assembly 30 and thereby contribute to establishment of totally backward draught on the leeward side of the fan. Because, in this instance, of the fact that the draught of air induced by the auxiliary vanes 33 is in a major proportion fed through the radiator grille structure 35 positioned in front of the fan, atmospheric air is allowed to pass through the radiator grille structure 35 at an increased rate of volumetric flow.

As will have been appreciated from the foregoing description, the fluid propeller fan proposed by the present invention is adapted to achieve an increased draught volume for a given duty and improved draught flow characteristics. If, therefore, the duty imposed on such a fluid propeller fan is unchanged, the fan can be constructed to provide a reduced rated air delivery capacity without sacrificing its performance efficiencies such as the air-circulating and cooling efficiencies when used as a cooling fan for an automotive internal combustion engine. When used as a cooling fan for an automotive engine, the fluid propeller fan provided by the present invention will thus permit of reduction of the dimensions and weight of the radiator grille structure and/or of reduction in the water circulation rate through the radiator grille structure to be used in combination with the fan. The improved draught flow characteristics of the fluid propeller fan according to the present invention will further permit of reduction of the rated revolution speed of the fan wheel rotor assembly thereof if the duty on the fan is unchanged. This will make the fan the less noisy.

What is claimed is:

1. A fluid propeller fan including a fan wheel rotor assembly which comprises:

a wheel hub having an axis therethrough and rotatable about the axis; and a plurality of vanes extending radially outwardly from said wheel hub and angularly spaced apart from each other about said axis of the wheel hub, each of the fan vanes having a predetermined pitch angle with respect to a plane perpendicular to said axis of said wheel hub;

wherein each of said vanes is provided with a radially outer longitudinal portion having, with respect to said plane, a pitch angle which is substantially constant throughout the length of said portion and a radially inner longitudinal portion having, with respect to said plane, a pitch angle which gradually decreases toward said wheel hub from said radially outer longitudinal portion.

* * * * *